US008881363B2

(12) United States Patent
Gunji et al.

(10) Patent No.: US 8,881,363 B2
(45) Date of Patent: Nov. 11, 2014

(54) FUEL INJECTION VALVE AND METHOD FOR COUPLING TWO COMPONENTS TOGETHER

(75) Inventors: Kenichi Gunji, Mito (JP); Masato Higuma, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 566 days.

(21) Appl. No.: 12/866,209

(22) PCT Filed: Jun. 24, 2009

(86) PCT No.: PCT/JP2009/062024

§ 371 (c)(1),
(2), (4) Date: Aug. 4, 2010

(87) PCT Pub. No.: WO2010/026826

PCT Pub. Date: Mar. 11, 2010

(65) Prior Publication Data

US 2011/0042490 A1 Feb. 24, 2011

(30) Foreign Application Priority Data

Sep. 5, 2008 (JP) ..... 2008-227720

(51) Int. Cl.

| | |
|---|---|
| ***B05B 1/30*** | (2006.01) |
| ***B05B 1/34*** | (2006.01) |
| ***F02M 51/00*** | (2006.01) |
| ***F02M 61/10*** | (2006.01) |
| ***F02M 61/00*** | (2006.01) |
| ***F02M 61/12*** | (2006.01) |
| ***F02M 61/16*** | (2006.01) |
| *F02M 61/18* | (2006.01) |
| *F02M 51/06* | (2006.01) |

(52) U.S. Cl.

CPC ..... *F02M 61/168* (2013.01); *F02M 61/188* (2013.01); *F02M 61/12* (2013.01); *F02M 61/1873* (2013.01); *F02M 2200/90* (2013.01); *F02M 2200/8053* (2013.01); *F02M 61/1806* (2013.01); *F02M 2200/8061* (2013.01); *F02M 2200/8084* (2013.01); *F02M 51/0671* (2013.01); *F02M 2200/16* (2013.01); *F02M 2200/8092* (2013.01)

USPC ..... 29/428; 239/533.11; 239/585.5

(58) Field of Classification Search

USPC ..... 239/533.1, 533.2, 533.3, 533.11, 583, 239/584, 585.1, 585.2, DIG. 19; 29/428

See application file for complete search history.

(56) References Cited

U.S. PATENT DOCUMENTS 5,127,156 A 7/1992 Yokoyama et al.
6,062,499 A * 5/2000 Nakamura et al. ..... 239/585.1

(Continued)

FOREIGN PATENT DOCUMENTS

DE 42 10 935 A1 10/1993
DE 4210935 A1 * 10/1993

(Continued)

OTHER PUBLICATIONS

International Search Report dated Oct. 6, 2009 with English translation (Five (5) pages).

(Continued)

*Primary Examiner* — Justin Jonaitis

(74) *Attorney, Agent, or Firm* — Crowell & Moring LLP

(57) ABSTRACT

There is provided a coupling process whereby two components can be coupled together at high positional precision regardless of precision of a single component.

A softer component 17 of two components 15, 17 to be coupled together is subjected to shearing by a corner 15*c* of a harder component 15 while respective parts of the two components 15, 17, positioning of the respective parts being required, are kept as-positioned state with the use of a mandrel 31, and a side face of the corner 15*c* is fitted to a sheared surface 17*c* of the softer component 17 during shearing in progress, subsequently coupling the two components 15, 17 together at a fitting surface by plastic coupling, press-fitting, or welding.

6 Claims, 13 Drawing Sheets

(56) References Cited

U.S. PATENT DOCUMENTS

| | | | | |
|---|---|---|---|---|
| 6,491,439 | B1 | 12/2002 | Zimmer | |
| 2004/0074994 | A1 * | 4/2004 | Ganzer | 239/533.1 |
| 2005/0161526 | A1 * | 7/2005 | Miller et al. | 239/88 |
| 2005/0173563 | A1 * | 8/2005 | Coldren et al. | 239/533.1 |
| 2008/0296414 | A1 | 12/2008 | Kubota et al. | |

FOREIGN PATENT DOCUMENTS

| | | | | |
|---|---|---|---|---|
| EP | 1 070 565 | A1 | 1/2001 | |
| EP | 1442830 | A1 * | 4/2004 | B23P 11/00 |
| EP | 1 442 830 | A1 | 8/2004 | |
| EP | 1 998 039 | A2 | 12/2008 | |
| GB | 2 236 359 | A | 4/1991 | |
| JP | 7-10471 | B2 | 5/1991 | |
| JP | 6-137120 | A | 5/1994 | |
| JP | 2000-345944 | A | 12/2000 | |
| JP | 2002-538037 | A | 11/2002 | |
| JP | 2003-129922 | A | 5/2003 | |
| JP | 2004-232464 | A | 8/2004 | |
| JP | 3931143 | B2 | 8/2004 | |
| JP | 2008-297966 | A | 12/2008 | |
| WO | WO 00/51856 | A1 | 9/2000 | |

OTHER PUBLICATIONS

Extended European Search Report dated Feb. 24, 2012 (eight (8) pages).

Extended European Search Report dated Nov. 14, 2012 (five (5) pages).

* cited by examiner

AN ENLARGED VIEW OF PART IV

AN ENLARGED VIEW OF PART V

AN ENLARGED VIEW OF PART VII

AN ENLARGED VIEW OF PART VIII

FUEL INJECTION VALVE AND METHOD FOR COUPLING TWO COMPONENTS TOGETHER

TECHNICAL FIELD

The present invention relates to a method for coupling two components together after positioning thereof, and a fuel injection valve manufactured by utilizing the method.

BACKGROUND ART

The method described in JP-B-Hei 7(1995)-10471 (Patent Document 1) is well known as a method for concentric coupling of components made up of a plurality of members. It is described in Patent Document 1 that, in FIG. 1, a tapered hole (valve seat) 10*c* is formed in the inner bottom of a nozzle body (an outer cylindrical component) 10, provided with an orifice 11, a swirler (an inner cylindrical component) 12 provided with a through-hole 12*a* is installed inside the nozzle body 10 while securing a clearance therebetween, and the vicinity of a fitting part between the swirler 12 and the nozzle body 10 (a side of the fitting part, adjacent to the swirler 12) is pressed down by a punch 16 in such a way as to cause localized plastic flow while centering of the tapered hole 10*c* and the through-hole 12*a* of the swirler 12 is maintained by use of a positioning guide pin 14, thereby causing both the components to undergo concentric plastic coupling by the force of the plastic flow.

Further, the method described in Japanese Patent No. 3931143 (Patent Document 2) is also well known. In Patent Document 2, it is described that, in addition to the method according to Patent Document 1, protrusions 10*d* are provided on the bottom of the nozzle body 10, and the swirler 12 is caused to interlock with the protrusions 10*d* to thereby mechanically suppress deviation in the radial direction, so that coaxiality is prevented from undergoing deterioration.

PRIOR ART LITERATURE

Patent Documents

Patent Document 1: JP-B-Hei 7(1995)-10471
Patent Document 2: Japanese Patent No. 3931143

SUMMARY OF THE INVENTION

Problems to be Solved by the Invention

With Patent Document 1, if coaxiality of the inside and outside diameters of the swirler is 0, and coaxiality of the inside diameter of the nozzle body, and the tapered hole is 0 when the swirler and the nozzle body are caused to undergo concentric coupling by the force of the plastic flow, a clearance between the inside diameter of the nozzle, and the outside diameter of the swirler will be consistent along the whole circumference. However, if the coaxiality is not 0 with respect to either the nozzle, or the swirler, the clearance between the inside diameter of the nozzle, and the outside diameter of the swirler will be inconsistent, so that stress occurring upon the coupling will be greater on a side where the clearance is smaller while the stress will be smaller on a side where the clearance, which is an axial target, is larger. For this reason, upon removal of the guide pin after the coupling, there occurs springback such that residual stress will become consistent all round. More specifically, the swirler moves from the side of smaller clearance toward the side of larger clearance, whereupon deviation occurs to coaxiality of the tapered hole, and the inside diameter of the swirler. Further, magnitude of the deviation is affected by coaxiality precision of components, and if the magnitude of the deviation reaches a predetermined value or higher, this will interfere with smooth movement of the movable valve, causing fuel leakage from the seat in the worst case.

Meanwhile, with Patent Document 2, the component 12 is caused to interlock with the protrusions 10*d*, thereby making an attempt for improvement with respect to a problem point of JP-B-Hei 7(1995)-10471. However, if the vicinity of the outer periphery of an upper end surface of the swirler 12 is pressed by protrusions 15*a* provided at the tip of a punch 15 in FIG. 3, thereby causing plastic coupling, this will raise the possibility that springback occurs to the pressed side of the swirler 12 due to the effect of component precision as is the case with Patent Document 1, and a swirler bore 12*a* is tilted, thereby causing deterioration in coaxiality.

Thus, with the conventional technology, coaxiality of the inside diameter of the swirler, and the seat surface, after the coupling, is affected by component precision, and unless respective components are worked on with high precision, those components cannot be assembled together with high precision, so that problems have been encountered in that not only a working cost is high but also fuel leakage from the seat occurs, and the movement of the movable valve is adversely affected.

It is therefore an object of the invention to provide a method for coupling two components together, insusceptible to the effect of precision of each of the components, and capable of maintaining coaxiality of the components with high precision, after coupling thereof, and another object of the invention is to provide a fuel injection valve manufactured by utilizing the method, excellent in oil-tight property, and capable of guiding a movable valve with high precision.

Means for Solving the Problems

To achieve the above objects, with the present invention, a softer member of the two components is subjected to shearing by a corner of a harder member of the two components while respective parts of the two components, positioning thereof being required, are kept in as-positioned state, a side face of the corner is fitted to a sheared surface of the softer member during shearing in progress, and subsequently, the two components are coupled at a fitting surface by plastic coupling, press-fitting, or welding.

Furthermore, a gap is provided between respective side faces of the two components except for at a fitting part as sheared in order to prevent external forces having effects on precision from being applied.

Effect of the Invention

With the method according to the present invention, the two components can be fitted together consistently all round (with zero gap) with reference to the respective parts whose positioning is established, and since coupling is effected at the fitting surface, there occurs no deterioration in precision due to springback, a gap, and so forth, so that the two components can be coupled together with high precision while the respective parts are kept in the as-positioned state. In addition, since coupling is effected without being affected by component precision, precision in assembly of the two components can be obtained.

With a fuel injection valve manufactured by use of the present invention, because coaxiality of a guide, and a seat surface is excellent, a valve body moves smoothly, so that it is possible to stably inject fuel with excellent responsiveness, and at high precision. Further, fuel leakage from a seat part related to assembly precision can be prevented.

BEST MODE FOR CARRYING OUT THE INVENTION

Embodiments of the invention are described hereinafter with reference to the accompanying drawings.

(First Embodiment)

Figure 1:
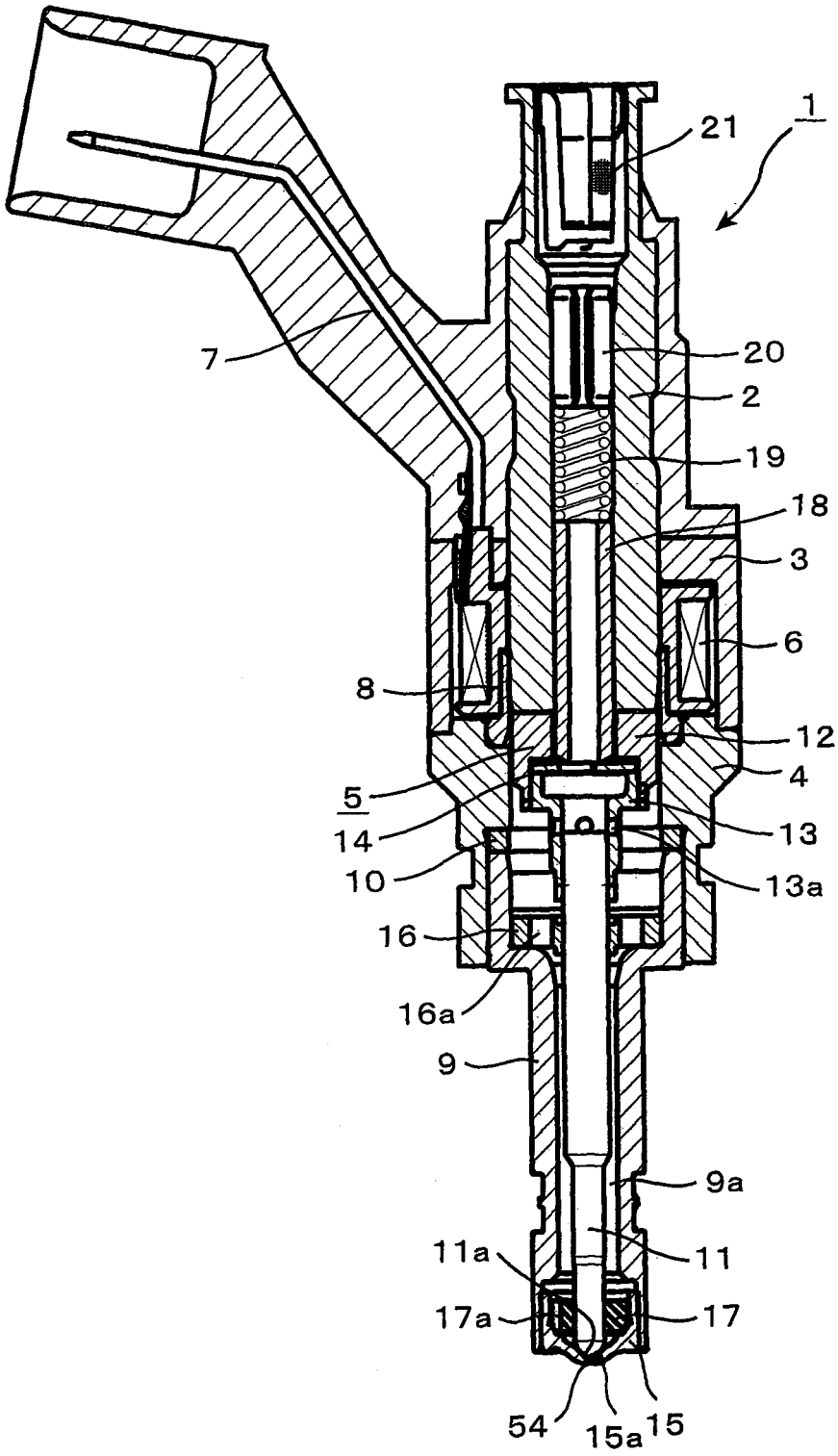
FIG. 1 is a longitudinal sectional view of a fuel injection valve according to a first embodiment of the invention.

FIG. 1 is a longitudinal sectional view showing the whole construction of a first embodiment of a fuel injection valve according to the invention.

A fuel injection valve main body 1 is comprised of a core 2, a yoke 3, a housing 4, a magnetic circuit made up of a movable element 5, a coil 6 for exciting the magnetic circuit, and a terminal block 7 for energizing the coil 6. A seal ring 8 is coupled between the core 2 and the housing 4, thereby preventing fuel from flowing into the coil 6.

Valve components are housed in the housing 4 where there are disposed the movable element 5, a nozzle 9, and a ring 10 for adjusting a stroke amount of the movable element 5. The movable element 5 is formed by coupling a valve body 11 with a movable core 12 at a joint 13. A plate 14 is for suppressing a bound that will occur upon the movable element 5 closing the valve in collaboration with a pipe 18, and the plate 14 is provided between the movable core 12, and the joint 13.

The housing 4, and the nozzle 9, making up an overcoat member, cover up the periphery of the movable element 5, the nozzle 9 has a seat surface 15*a*, and an orifice 54, at the tip thereof, and the nozzle 9 is provided with a nozzle 15 cup-like in shape, and a guide 17 slidably holding the movable element 5 in collaboration with a guide plate 16.

Disposed inside the core 2 are a spring 19 for pressing down the valve body 11 to the seat surface 15*a* through the pipe 18 and the plate 14, an adjuster 20 for adjusting a press-down load of the spring 19, and a filter 21 for preventing the ingress of contaminant from outside.

Now, operation of the fuel injection valve main body 1 is described in detail hereinafter.

Upon energization of the coil 6, the movable element 5 is drawn toward the core 2 by suction against the urging of the spring 9, whereupon a gap is formed between a valve seat 11*a* and the seat surface 15*a* at the tip of the movable element 5(a open valve state). Pressurized fuel enters the nozzle 9 first from the core 2, the adjuster 20, and the pipe 18 via a fuel passage 13*a* inside the movable element 5. Subsequently, the fuel passes through a fuel passage 16*a* inside the guide plate 16, and a passage 17*a* inside the guide 17 to be injected through the gap between the valve seat 11*a* and the seat surface 15*a* via the orifice 54.

On the other hand, if current to the coil 6 is cut off, the valve seat 11*a* of the movable element 5 is butted against the seat surface 15*a* by the force of the spring 19, and a closed-valve state is brought about.

Figure 2:
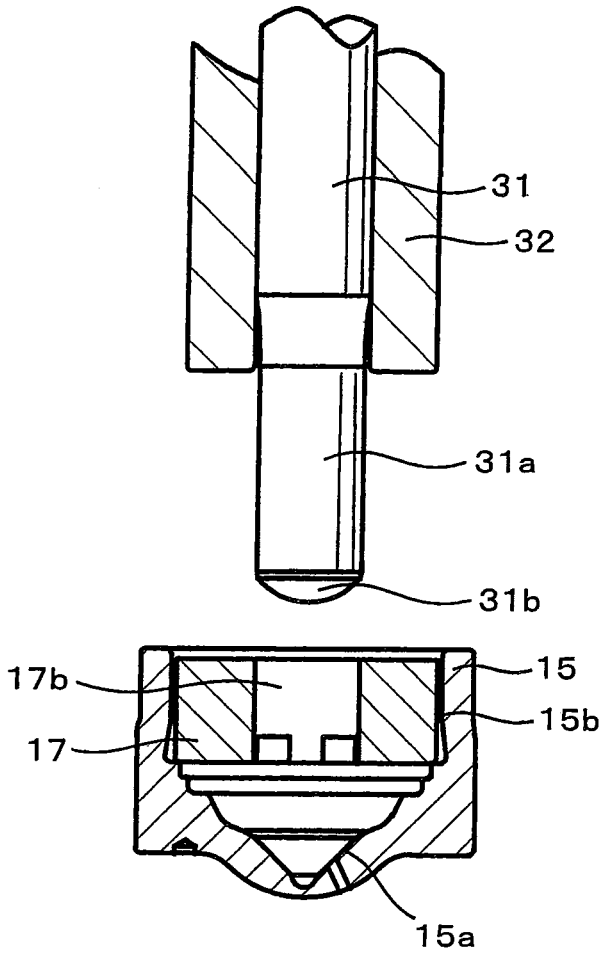
FIG. 2 is a longitudinal sectional view showing the nozzle and the guide in as-set state, and an assembly jig.
Figure 6:
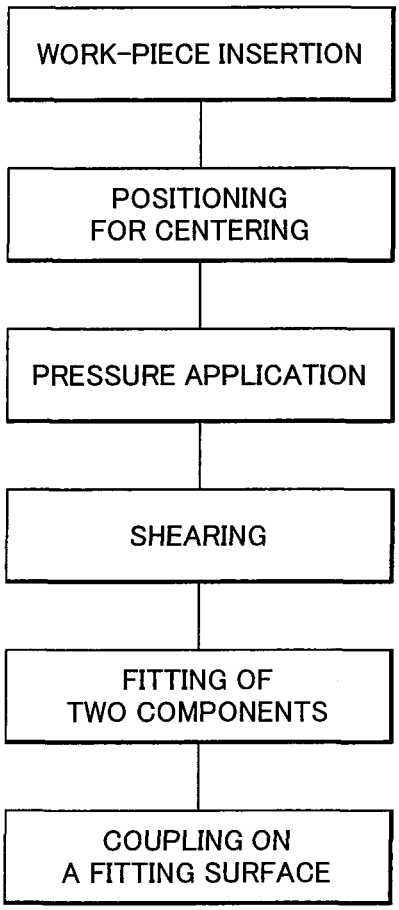
FIG. 6 is a flow chart showing a process of coupling the nozzle with the guide.
Figure 7:
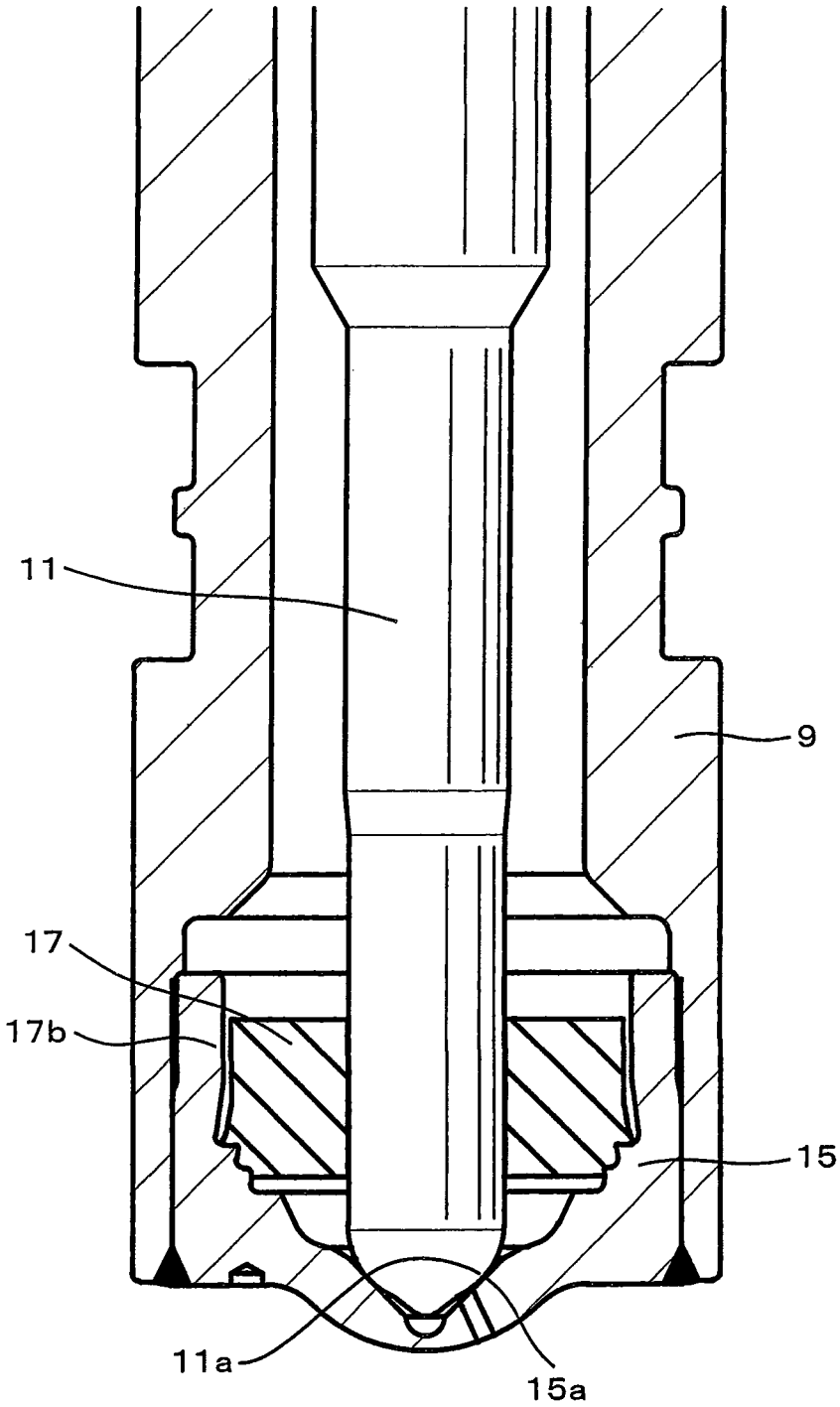
FIG. 7 is an enlarge view showing the nozzle and the guide of the fuel injection valve after completion of assembling.

Next, a method for coupling the nozzle 15 with the guide 17 is described hereinafter with reference to FIGS. 2 to 7. FIG. 2 is a longitudinal sectional view showing the nozzle and the guide in as-set state, and an assembly jig, FIG. 3 a longitudinal sectional view showing the nozzle and the guide in as-positioned state, FIG. 4 a longitudinal sectional view showing the nozzle and the guide in as-sheared state, FIG. 5 a longitudinal sectional view showing the nozzle and the guide in as-coupled state, FIG. 6 a flow chart showing a process of coupling the nozzle with the guide, and FIG. 7 is an enlarge view showing the nozzle and the guide of the fuel injection valve after completion of assembling.

The coupling of the nozzle 15 with the guide 17 has a purpose that the valve body 11 is slidably held in a guide center hole 17*b* of the guide 17, and further, the valve seat 11*a* is in intimate contact with the seat surface 15*a* to thereby seal fuel. Accordingly, the guide center hole 17*b* need be coupled with the seat surface 15*a* at concentricity of, for example, not more than 10 μm. Furthermore, the nozzle 15 has hardness not less than HRC 52, and the guide 17 has hardness in a range of 130 to 350 Hv.

First, the guide 17 is set inside the nozzle 15, as shown in FIG. 2. This corresponds to a process step "workpiece insertion" shown in FIG. 6.

Figure 3:
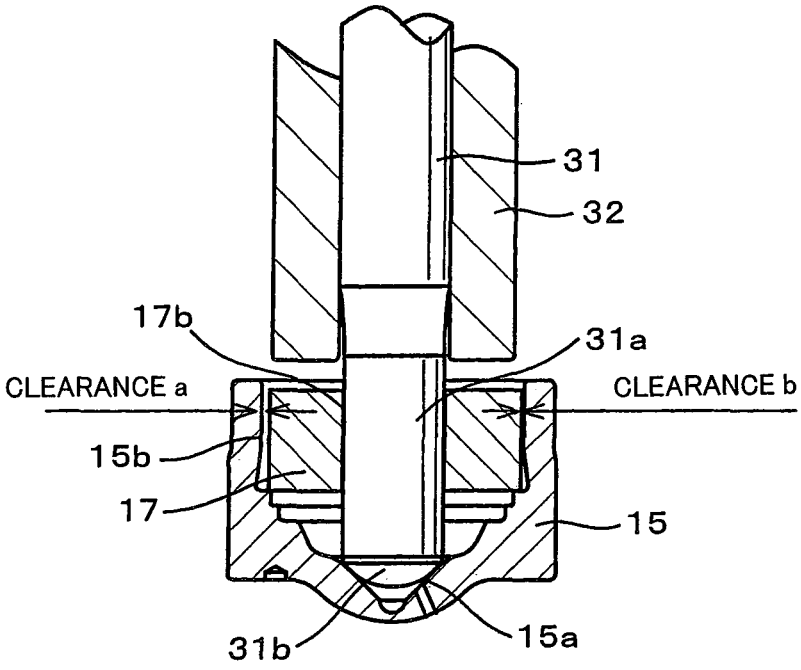
FIG. 3 is a longitudinal sectional view showing the nozzle and the guide in as-positioned state.

With the components kept in this state, a guide 31*a* of a mandrel 31 is inserted into the guide center hole 17*b*, as shown in FIG. 3, and a spherical surface 31*b* is butted against the seat surface 15*a*, thereby executing centering of the guide center hole 17*b* with reference to the seat surface 15*a*. This corresponds to a process step "positioning for centering", shown in FIG. 6. At this point in time, if there is deviation in centering of, for example, the outside diameter of the guide 17 and the guide center hole 17*b*, or the inside diameter 15*b* of the nozzle 15 and the seat surface 15*a*, a difference in space will occur between a clearance "a" and a clearance "b".

Figure 4A:
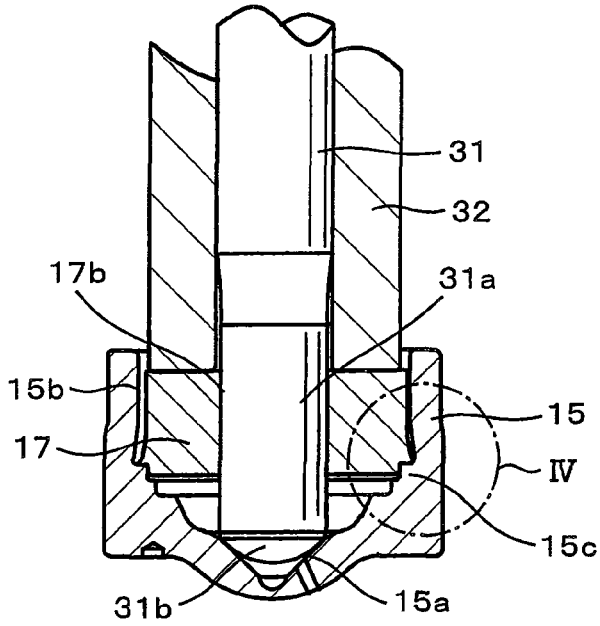
FIG. 4 is a longitudinal sectional view showing the nozzle and the guide in as-sheared state.
Figure 4B:
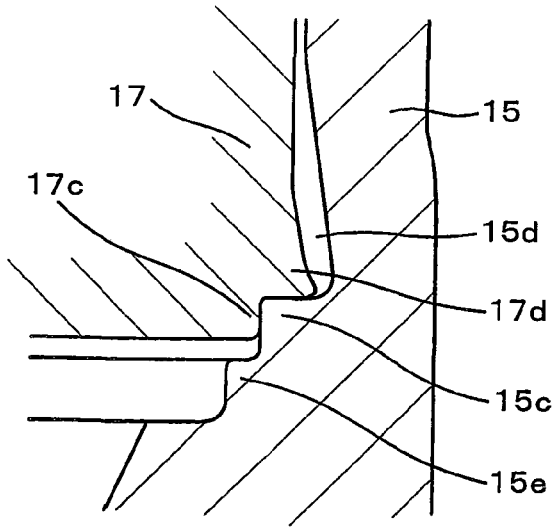

Then, a punch 32 is caused to descend, so that the punch 32 is butted against the guide 17. When the punch 32 is caused to further descend, an edge of the guide 17 is interlocked by a step A15*c* as shown in FIG. 4, and the corner of the guide 17 is subjected to shearing. At this point in time, a sheared part 17*c* will be gradually fitted to a side face of the step A15*c* without a gap being created therebetween. This corresponds to process steps "pressure application", "shearing", and "fitting of two components together", as shown in FIG. 6. Meanwhile, an excess metal 17*d* as sheared is pushed out into a relief space 15*d*, but the excess metal 17*d* will not come to be butted against the inside diameter of the nozzle 15.

Figure 5B:
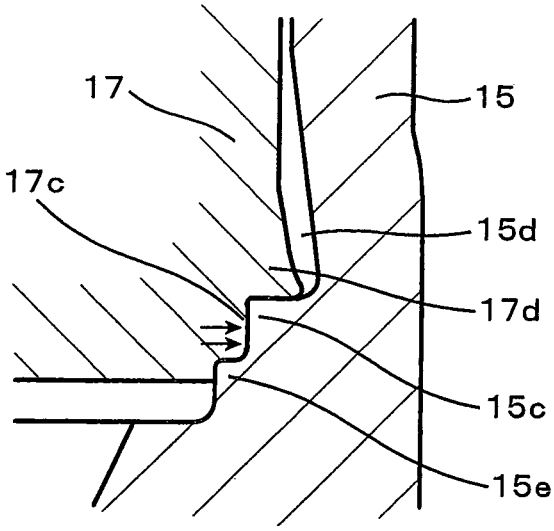
FIG. 5 is a longitudinal sectional view showing the nozzle and the guide in as-coupled state.

As the punch 32 continues to descend, the corner of the guide 17 is interlocked by a step B15*e*, as shown in FIG. 5, and the sheared part 17*c* will undergo plastic flow in a direction at about 90° to a direction in which a pressure is applied, that is, towards the side face of the step A15*c* to be press-bonded and coupled therewith by an auto-straining force (a residual stress). This corresponds to a process step "coupling on a fitting surface", as shown in FIG. 6.

As shown in FIG. 7, after completion of assembling, the valve body 11 is inserted into a part of the guide, where the mandrel 31 is inserted in FIG. 5, and the valve body 11 is guided by the guide 17.

As described in the foregoing, two components are coupled together only on a fitting surface with the sheared part 17*c* kept fitted to the side face of the step A15*c* without the gap formed therebetween while centering of the seat surface 15*a* and the guide center hole 17*b* is maintained, so that the residual stress will be uniform along the whole periphery, and coupling with high precision can be implemented without deviation of the guide 17 even after removal of mandrel 31.

Figure 14:
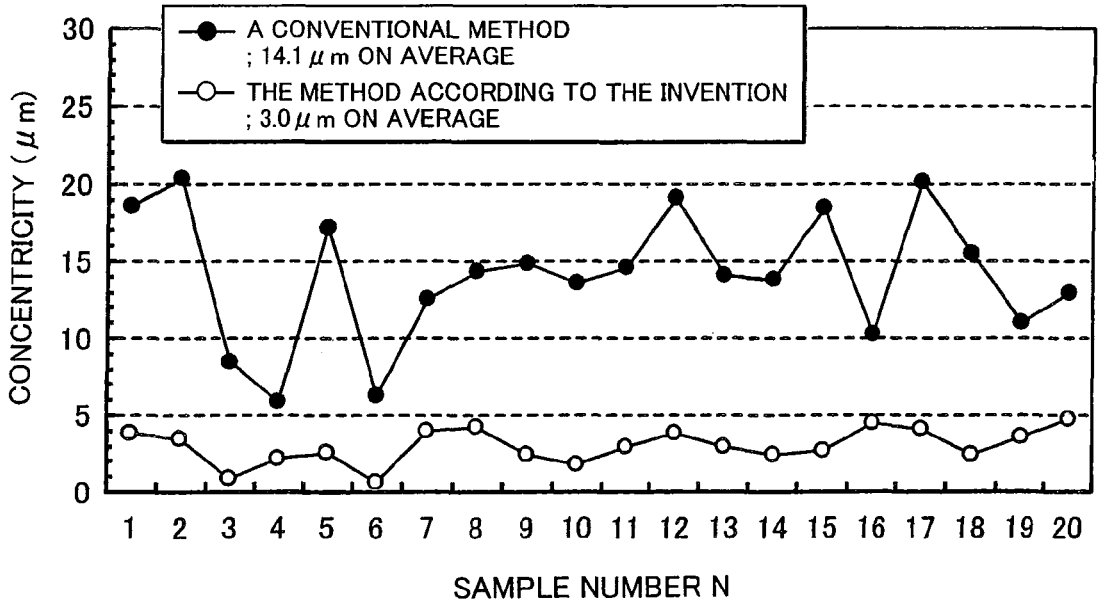
FIG. 14 is a graph showing results of comparing concentricity of the nozzle and the guide for the method according to the first embodiment with that for a conventional method.

FIG. 14 shows results of testing conducted on coupling of components, in which coaxiality of the outside diameter of the guide 17 and the guide center hole 17*b* is in a range of 5 to 25 μm. With a conventional method, such as the method according to Patent Document 2, concentricity of the seat surface 15*a* and the guide center hole 17*b*, after coupling, normally used to be 14.1 μm on average, however, with the present invention, the concentricity can be enhanced to 3 μm on average, and significant improvement is observed in both precision and variation.

Furthermore, the guide 31*a* of the mandrel 31 is preferably inserted into the guide center hole 17*b* without a gap being created therebetween, more preferably press-fitted therein. In addition, the outside diameter of the guide 17 is preferably not butted against the inside diameter 15*b* of the nozzle 15 except for at coupled parts, and a dimensional relationship between the outside diameter of the guide 17 and the inside diameter 15*b* of the nozzle 15 is set such that a clearance is provided therebetween.

Figure 8A:
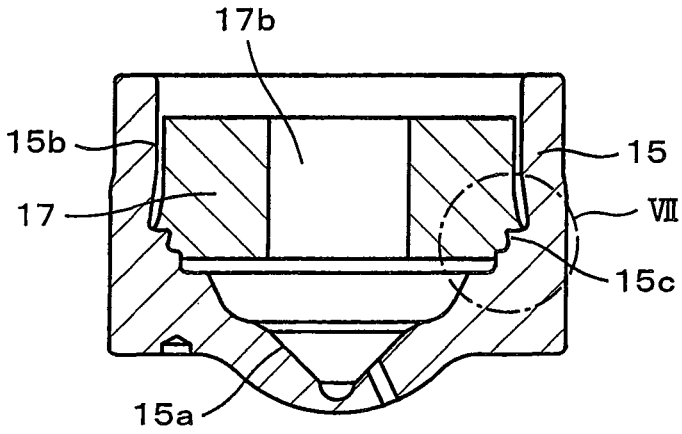
FIG. 8 is a longitudinal sectional view showing the nozzle and the guide in as-coupled state.
Figure 8B:
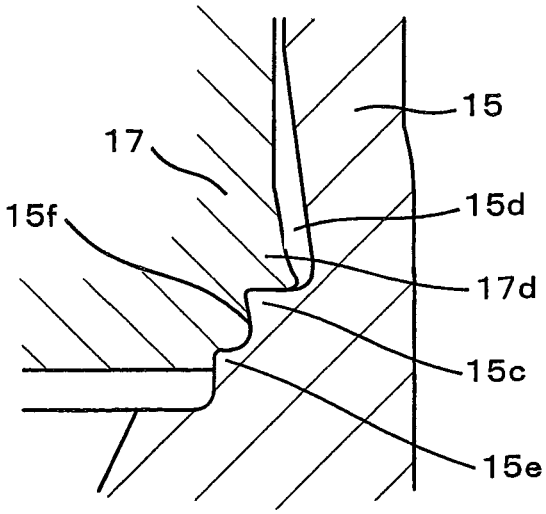
Figure 9A:
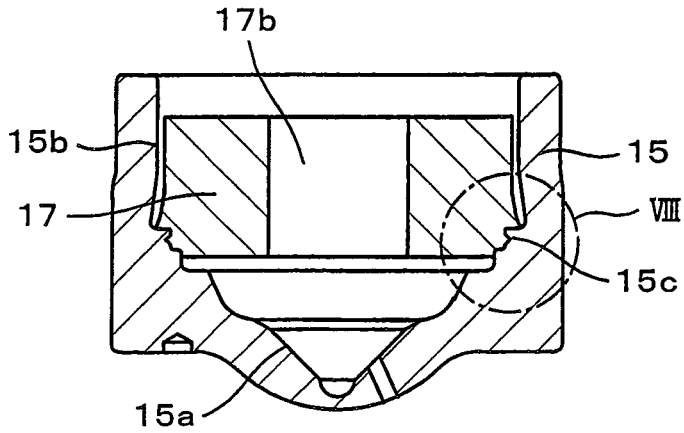
FIG. 9 is another longitudinal sectional view showing the nozzle and the guide in as-coupled state.
Figure 9B:
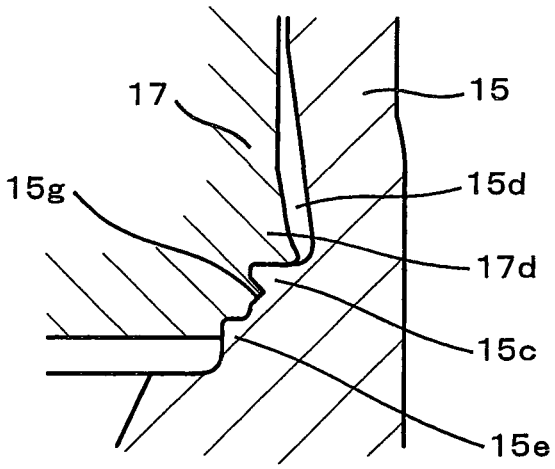

Referring to FIG. 5, in order to enhance strength of coupling between the nozzle and the guide, the side face of the step A15*c* may be provided with a plastic flow region, as shown in FIGS. 8 and 9, respectively.

In FIG. 8, the side face of the step A15*c* is provided with an undercut portion 15*f*, and material is caused to flow into the undercut portion 15*f* due to plastic flow occurring upon the corner of the guide 17 being interlocked by a step B15*e*, thereby further enhancing the strength of the coupling.

A method for coupling the nozzle with the guide is the same as that described with reference to FIGS. 2 to 5, and concentricity after coupling is equivalent to that described as above.

Further, in FIG. 9, a coupling groove 15*g* is provided in place of the undercut portion 15*f*. In this connection, a plurality of the coupling grooves 15*g* may be provided.

If the undercut portion 15*f*, or the coupling groove 15*g* is provided, this will enable the strength of the coupling to be enhanced two to three times greater than the strength of the coupling by the auto-straining, shown in FIG. 5, and therefore, any of those is provided according to strength as required.

(Second Embodiment)

Figure 10:
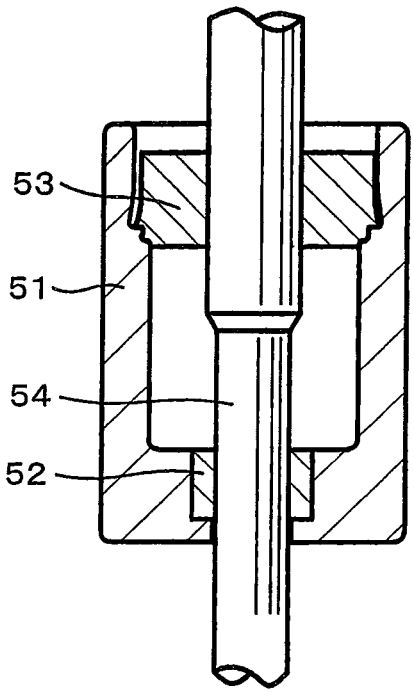
FIG. 10 is a longitudinal sectional view showing a bearing structure as one embodiment of the invention.

In FIG. 10, there is shown a bearing structure according to a second embodiment of the invention.

A bearing A52, and a bearing B53 are coaxially secured inside a holder 51, and an axle 54 is supported at two points. A method for assembling the bearing structure comprises the process steps of nesting a bearing B53 in an bore 51*a* of a holder 51 with a bearing A52 securely attached thereto by press-fitting and so forth, as shown in FIG. 11, and tentatively assembling with reference to the inside diameter of the bearing A52 by use of a centering part 54*a* while positioning the inside diameter of the bearing B53 by use of a mandrel 54.

Subsequently, as is the case with the method described with reference to FIGS. 2 to 5, the bearing B53 is pressed down by a punch 55, the corner of the bearing B53 is fitted a side face of a step A51*b* while the corner of the bearing B53 is subjected to shearing by the step A51*b*, and subsequently, the corner of the bearing A53 is interlocked by a step B51*c*, and the bearing A53 is coupled to the side face of the step A51*b*, as a fitting surface, due to plastic flow.

Figure 11:
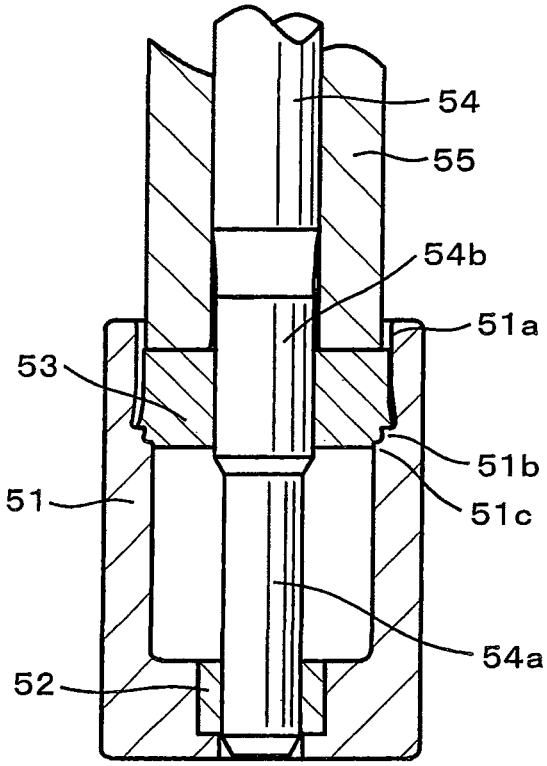
FIG. 11 is a longitudinal sectional view showing a method for coupling a housing to a bearing, according to a second embodiment of the invention.
Figure 12:
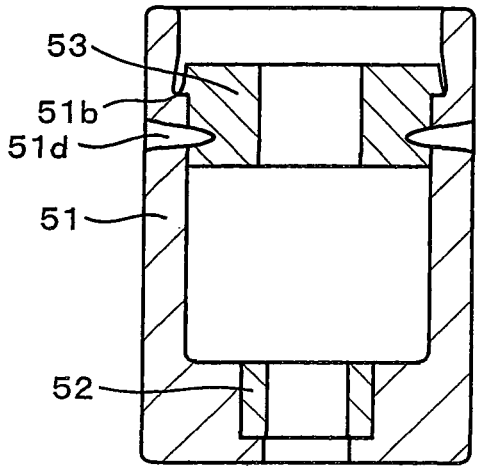
FIG. 12 is a longitudinal sectional view showing a structure for coupling a housing to a bearing (by welding)

FIG. 12 shows a working example adopting welding in place of plastic coupling, and as in the case of the second embodiment shown in FIG. 11, while the corner of a bearing B53 is subjected to shearing by a step A51*b*, a portion of the corner, in a necessary length, is fitted to a holder 51 to be thereby coupled thereto on a fitting surface by laser welding, and so forth, like a welded part 51*d*.

In the case of coupling by welding, a prerequisite for prevention of deviation in centering is to execute press-fitting, however, if the press-fitting is executed, centering by use of the mandrel 54 cannot be effected, so that it has been necessary to cause coaxiality of all parts related to coupling to approximate 0.

Figure 13:
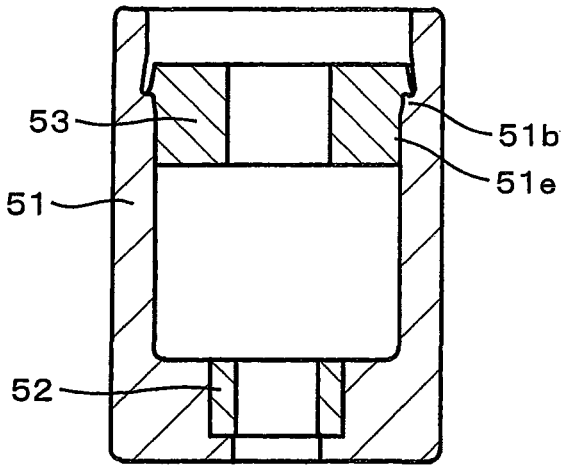
FIG. 13 is a longitudinal sectional view showing a structure for coupling a housing to a bearing (bypress-fitting)

FIG. 13 shows a working example in which press-fitting is adopted to implement coupling. In this case, a holder 51 is used in which a bore 51*e*, on the lower side of a step A51*b* (as seen in the figure), is worked so as to be stepped (reduced in diameter) as necessary, and be coaxial in order to acquire a press-fitting strength, and the corner of a bearing B53 is fitted to a step A51*b* while subjected to shearing by the step A51*b*, thereby concurrently press-fitting by pushing the bearing B53 as it is into the bore 51*e*. In the case of press-fitting, for strict control of an allowance for press-fitting, two components must be accurately worked on with respect to the inside and outside diameters of two components, however, with the present embodiment, it need only be sufficient to control a difference in step level on the bore of the holder 51, so that variation in coupling strength can be reduced, and both working on components, and size control can be carried out with ease and at low costs.

Having described the method for assembling the bearing structure with reference to FIGS. 11 to 13, as above, it is to be pointed out that with any of coupling methods, the outside diameter of the bearing B is subjected to shearing by the step A while the bearing B is kept in centering state with reference to the bearing A by use of the mandrel, and two components can be fitted together without any gap being created therebetween, so that deviation in centering does not occur after coupling regardless of a coupling method, and the bearing A and the bearing B can be coupled together with excellent coaxiality, and at high precision without being affected by component precision.

While the embodiments of the present invention have been specifically described as above, it is to be understood that the present invention is not limited thereto, and that various changes and modifications may be made in the present invention without departing from the spirit and scope thereof. With the present invention, for example, coaxiality has been described, however, with respect to positional precision, the same advantageous effect can be obtained, and high-precision positioning and assembling can be attained. Further, the excess metal generated upon shearing can be removed by pushing the bearing B to a greater depth.

Furthermore, with the second embodiment of the invention, the holder that is a hard component is provided with the step, however, if a hard metal is used for a bearing, a soft holder may be used, and a step may be provided on the outside diameter of the bearing that is hard.

With the embodiments of the present invention, if two components are coupled together with excellent positional precision, precision of a single component of the components will have no effect on coupling, so that it is possible to maintain precision after coupling, corresponding to the positional precision. Further, in the case of assembling with excellent positional precision by welding, and press-fitting, no means other than enhancement of single component precision have been available, however, with the embodiments of the present invention, precision can be enhanced at the time of assembling. Accordingly, even with the use of inexpensive components poor in single component precision, assembling at high precision can be implemented.

EXPLANATION OF REFERENCE NUMERALS

15 nozzle
15*a* seat surface
15*b* inside diameter of the nozzle
15*c* step A
15*d* relief space
15*e* step B
15*f* undercut portion
15*g* coupling groove
17 guide
17*b* guide center hole
17*c* sheared part
17*d* excess metal
31 mandrel
31*a* guide
31*b* spherical surface
32 punch

The invention claimed is:

1. A method for coupling two components together, which comprises:

subjecting a softer member of the two components to shearing with a corner of a harder member of the two components while respective parts of the two components, positioning thereof being required, are kept in as-positioned state;

fitting the two components together between a side face of the corner of the harder member, and a sheared surface of the softer member; and further coupling the two components together in a fitting surface where the two components are fitted;

wherein the coupling in the fitting surface is effected by plastic coupling or press-fitting;

the harder member is an outer cylindrical component with a bottom, having plural levels of steps on the inner surface thereof, and a tapered hole at the center of an inner bottom thereof while the softer member is in an inner cylindrical component having a through hole at the center thereof;

a guide pin for positioning is inserted into the through hole of the inner cylindrical component until the guide pin is butted against the tapered hole of the outer cylindrical component with a bottom of the inner cylindrical component kept placed on the plural levels of the steps of the outer cylindrical component, thereby effecting tentative concentric positioning of both the through hole of the inner cylindrical component and the tapered hole of the outer cylindrical component, and the bottom of the inner cylindrical component is then interlocked by the plural levels of the steps of the outer cylindrical component by pressing down the inner cylindrical component while maintaining a clearance between the inside diameter of the outer cylindrical component and the outside diameter of the inner cylindrical component, so that the bottom of the inner cylindrical component is coupled to the outer cylindrical component by an auto-straining force as a residual stress occurring to a side face of at least one step among the plural levels of the steps;

an inner peripheral surface of the outer cylindrical component and an outer peripheral surface of the inner cylindrical component are in contact together only at the plural levels of the steps located at the bottom of the inner cylindrical component, and a gap exists therebetween except for at the plural levels of the steps.

2. The method for coupling two components together, according to claim 1, wherein the side face of at least one step among the plural levels of the steps of the outer cylindrical component is provided with an undercut portion, and the inner cylindrical component is coupled with the outer cylindrical component by an auto-straining force as a residual stress occurring to the undercut portion, and by use of a portion of the softer member, undergoing plastic flow to the undercut portion.

3. The method for coupling two components together, according to claim 1, wherein the harder member is an outer cylindrical component with a bottom, having plural levels of steps on the inner surface thereof, and a hole having a straight section at the center of an inner bottom thereof while the softer member is an inner cylindrical component having a through hole at the center thereof, a guide pin for positioning is inserted into the through hole of the inner cylindrical component until the guide pin is guided by the straight section of the hole of the outer cylindrical component with the inner cylindrical component kept placed on the plural levels of the steps of the outer cylindrical component, thereby effecting tentative concentric positioning of both the inner cylindrical component and the outer cylindrical component, and the inner cylindrical component is interlocked by the plural levels of the steps of the outer cylindrical component by pressing down the inner cylindrical component, so that the inner cylindrical component is coupled with the outer cylindrical component by an auto-straining force as a residual stress occurring to a side face of at least one step among the plural levels of the steps.

4. The method for coupling two components together, according to claim 3, wherein the side face of at least one step among the plural levels of the steps of the outer cylindrical component is provided with an undercut portion, and the inner cylindrical component is coupled with the outer cylindrical component by an auto-straining force as a residual stress occurring to the undercut portion and by use of a portion of the softer member, undergoing plastic flow to the undercut portion.

5. The method for coupling two components together, according to claim 1, wherein a step among the plural levels of the steps of the outer cylindrical component, the step being one interlocking with the inner cylindrical component at first, forms a sheared surface on the inner cylindrical component, and subsequently, the step interlocking with the inner cylindrical component causes a portion of the inner cylindrical component to undergo plastic flow in a direction at about 90 degrees to an interlocking direction, thereby causing the inner cylindrical component to be coupled with the side face of the step interlocking with the inner cylindrical component at first by plastic flow.

6. A method of coupling two components together, comprising:

subjecting an inner cylindrical softer component of the two components to shearing with a corner of an outer cylindrical harder component while respective parts of the two components, positioning thereof being required, are kept in as-positioned state;

fitting the two components together between a side face of the corner of the harder component and a sheared surface of the softer member; and coupling the two components in a fitting surface where the two components are fitted;

wherein the coupling in the fitting surface is effected by plastic coupling or press-fitting;

the harder member is an outer cylindrical component with a bottom, having plural levels of steps on the inner surface thereof, and a tapered hole at the center of an inner bottom thereof while the softer member is in an inner cylindrical component having a through hole at the center thereof;

a guide pin for positioning is inserted into the through hole of the inner cylindrical component until the guide pin is butted against the tapered hole of the outer cylindrical component with a bottom of the inner cylindrical component kept placed on the plural levels of the steps of the outer cylindrical component, thereby effecting tentative concentric positioning of both the through hole of the inner cylindrical component and the tapered hole of the outer cylindrical component, and the bottom of the inner cylindrical component is then interlocked by the plural levels of the steps of the outer cylindrical component by pressing down the inner cylindrical component while maintaining a clearance between the inside diameter of the outer cylindrical component and the outside diameter of the inner cylindrical component, so that the bottom of the inner cylindrical component is coupled to the outer cylindrical component by an auto-straining force as a residual stress occurring to a side face of at least one step among the plural levels of the steps;

an inner peripheral surface of the outer cylindrical component and an outer peripheral surface of the inner cylindrical component are in contact together only at the plural levels of the steps located at the bottom of the inner cylindrical component, and a gap exists therebetween except for at the plural levels of the steps;

wherein the outer cylindrical softer component and the inner cylindrical harder component in concentric relationship each has a plurality of steps in an inner surface and an outer surface respectively along the center axis of the outer cylindrical softer component and the inner cylindrical harder component in such a manner that the steps of the outer cylindrical softer component and the inner cylindrical harder component match each other; and wherein when a guide pin, which is removable after the coupling is completed, is inserted into the inner cylindrical component, the outer cylindrical component is sheared at the first step, followed by shearing at the second step, and when the sheared parts plastically flow into the side face of the first step, the outer cylindrical softer component, and the inner softer cylindrical component are coupled at the second step.

* * * * *